United States Patent [19]

Robson

[11] Patent Number: 4,856,569

[45] Date of Patent: Aug. 15, 1989

[54] MACHINES FOR CUTTING END JOINTS

[75] Inventor: Thomas Robson, Houghton-le-Spring, United Kingdom

[73] Assignee: Wadkin plc, Leicester, England

[21] Appl. No.: 246,547

[22] PCT Filed: Mar. 11, 1987

[86] PCT No.: PCT/GB87/00166

§ 371 Date: Sep. 12, 1988

§ 102(e) Date: Sep. 12, 1988

[87] PCT Pub. No.: WO87/06175

PCT Pub. Date: Oct. 22, 1987

[30] Foreign Application Priority Data

Apr. 11, 1986 [GB] United Kingdom ..... 8608892

[51] Int. Cl.[4] ..... B27F 1/16

[52] U.S. Cl. ..... 144/91; 144/2 R; 144/134 A; 144/363; 144/347

[58] Field of Search ..... 409/203, 213, 217; 144/2 R, 90 R, 90 A, 91, 82, 84, 85, 134 R, 134 A, 347, 363, 354

[56] References Cited

U.S. PATENT DOCUMENTS

| | | | |
|---|---|---|---|
| 3,179,135 | 4/1965 | Windsor | 144/91 |
| 3,602,275 | 8/1971 | Nissen | 144/91 |
| 3,844,320 | 10/1974 | Dimter | 144/91 |
| 3,951,189 | 4/1976 | Croomeens | 144/91 |
| 4,130,150 | 12/1978 | Cook et al. | 144/90 A |
| 4,248,280 | 2/1981 | Taylor | 144/3 R |
| 4,557,303 | 12/1985 | Gardner et al. | 144/134 A |

*Primary Examiner*—W. Donald Bray

*Attorney, Agent, or Firm*—Kalish & Gilster

[57] ABSTRACT

The machine is suitable for working wood, materials derived from wood, etc. A rotary cutter (10) is movable past tables (12, 14, 16) for supporting workpieces. The cutter (10) comprises a number of cutting discs set coaxially and separated by spacers. On each table (12, 14, 16) a workpiece can be set at a different level. Movement of the cutter along the ends of the workpieces on a single pass can cut a different joint in each workpiece. The thickness and diameter respectively of the cutting discs determine the width and depth of the slots cut in the workpieces for the formation of joints. The thickness of the spacers determines the spacing of the slots, not only in an individual workpiece but also on a number of workpieces set on the various tables (12, 14, 16).

5 Claims, 3 Drawing Sheets

MACHINES FOR CUTTING END JOINTS

TECHNICAL FIELD

The invention relates to machines for cutting end joints on workpieces of wood, materials derived from wood, plastics and the like. Machines according to the invention are suitable for processing square dressed or moulded timber in the manufacture of frame members for windows or doors. In this operation, they can be used to cut a tenon in a single end of each of a number of workpieces in a single cycle. Alternatively, such machines can be used for cutting tongues and grooves, mitres, finger joints, or locating feathers.

BACKGROUND ART

Single-end tenoning machines generally comprise a rotary cutter fixed in relation to the machine, and a bed for moving a workpiece past the cutter. Such machines have limited capacity as the backing piece has to be changed at the end of each cycle. Patent Specification GB No. 2,125,729A (Boardman) describes an end-forming machine in which a tenoning cutter is moved in a lateral direction to engage one end of each of two workpieces. After one end has been tenoned, a workpiece can be moved longitudinally to a position in which the cutter tenons the other end. The machine still has limited capacity.

THE INVENTION

A machine according to the invention comprises a rotary cutter having a number of cutting discs, set coaxially and separated by spacers, and movable past means for supporting workpieces, the support means comprising at least two tables, each of which can adjustably be set at a different level in relation to the machine and in relation to each other.

Movement of the cutter along the ends of the workpieces in a single pass is thus capable of cutting a different joint in each workpiece. The thickness and diameter respectively of the cutting discs determine the width and depth of the slots cut in the workpieces for the formation of joints. The thickness of the spacers determines the spacing of the slots, not only in an individual workpiece but also on a number of workpieces set on the various tables. A single extractor for chips cut in the machining may be provided around the cutter.

The arrangement of three tables side by side is preferred, as it is not practicable to have more than three cutting discs on a spindle without top support, and a top support would complicate the design. Additional tables may be arranged on the other side of the cutter in relation to the machine so that a greater number of workpieces can be cut in a single pass. Mechanism may be provided for a workpiece to be moved longitudinally from one side of the cutter to the other after one end has been cut, so that the other end can be cut on the next pass of the cutter.

The cutter may be provided with a multi-speed motor for adjustment according to cutter diameter and to provide optimum space for the workpiece. The means for moving the cutter may include a multi-speed motor, so that the machine can be programmed to make a return movement of a cutter not engaging a workpiece quicker than an advance or cutting movement or may be programmed to move at varying speeds on the cutting stroke. In this way break-out may be mitigated, and cycle time may be optimized. It is also possible to power the table movement, and provide a programme for its control in cooperation with the cutter so as to automate the machine.

The workpieces are set at different levels through the tables themselves being settable so that a number of similar workpieces can each have the same end joint formation cut in an end. Alternatively a number of workpieces can be loaded on each table, the level of each table being adjustable, for example by half a pitch so that complementary end joints are cut in the workpieces on each table. This can be useful in the formation of finger joints or corner locking for example.

DRAWINGS

BEST MODE

Figure 1:
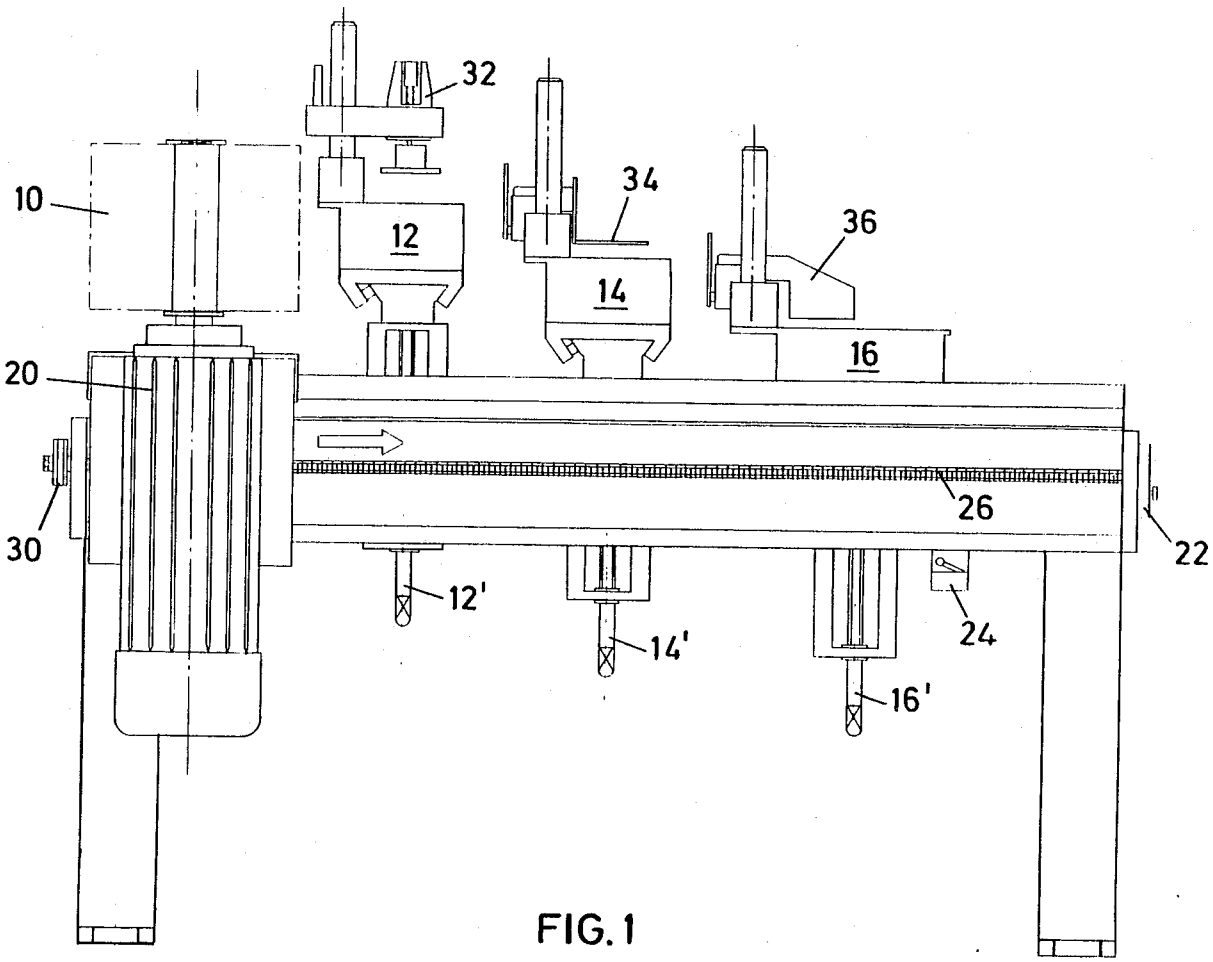
FIG. 1 is a side elevation of a machine according to the invention.

With particular reference to FIG. 1, the machine comprises a rotary cutter 10 movable from left to right past three tables 12, 14, 16 for supporting workpieces. The cutter 10 has a number of cutting discs (not individually shown) separated by spacers and set on a sleeve for rotation as a unit about a spindle in a manner known in itself. The tables are each provided with a vertical adjustment screw 12', 14', 16' through which workpieces can be set at different levels in relation to the machine. Thus movement of the cutter 10 along the ends of the workpieces from left to right in FIG. 1 cuts a joint in the end of each workpiece in a single pass.

The cutter 10 is provided with a main motor 20 which can be switched on with the remainder of the machine by pushing a button on a control panel 22. The cutter 10 and main motor 20 are movable past the tables 12, 14, 16 along a traverse screw 26 by a traverse motor 28 (FIG. 3) through a drive connection 30. The traverse motor 28 can be reversed at the end of the pass by a limit switch 24. The position of the limit switch 24 may be adjusted or varied, possibly so as to be situated after each table, to assist in the control of the machine.

The table 12 is shown as provided with a clamp 32 for securing a workpiece. The table 14 is shown as provided with a shoulder stop 34, and the table 16 with an end stop 36. In fact, each table is provided with all these accessories, and those not shown have been omitted in the interests of clarity. These accessories are manually operable, but could be pneumatically actuated, for example as part of a numerical control system for the machine as a whole.

Figure 2:
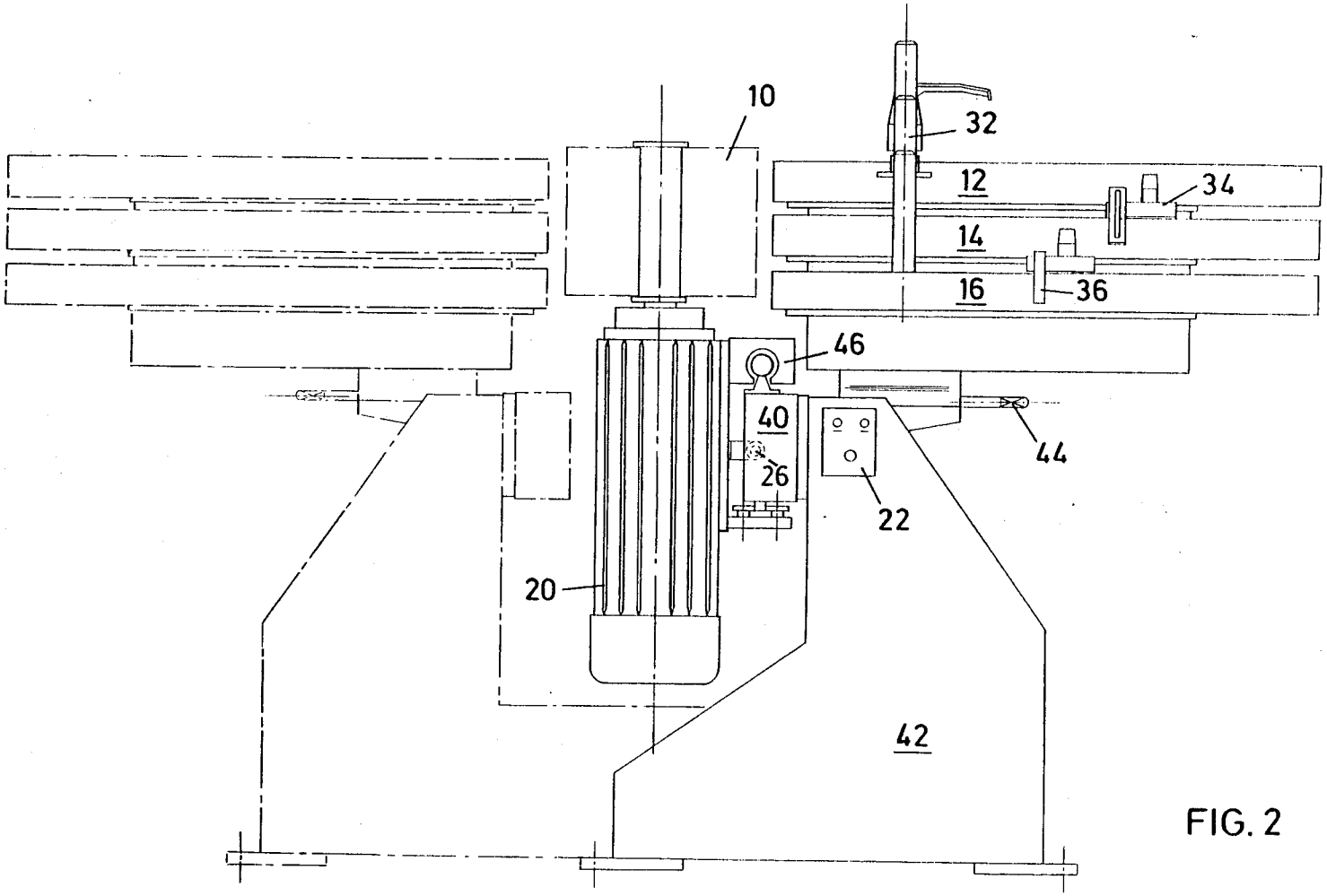
FIG. 2 is a front elevation of the machine shown in FIG. 1, with the arrangement of an additional set of tables shown in broken lines to the left.

FIG. 2 shows how the traverse screw 26 is mounted on a beam 40, which itself is mounted on a beam support 42, which is the main frame member of the machine. FIG. 2 also shows a horizontal adjustment screw 44 through which the proximity of the tables 12, 14, 16 to the cutter 10 can be varied. The cutter 10, through the main motor 20, is fast on a carriage 46 which runs along the traverse screw under the power of the traverse motor 28.

OPERATION

Workpieces are clamped on the three tables 12, 14, 16, each contacting an end stop 36, and having its other end projecting from the table towards the cutter 10.

Figure 3:
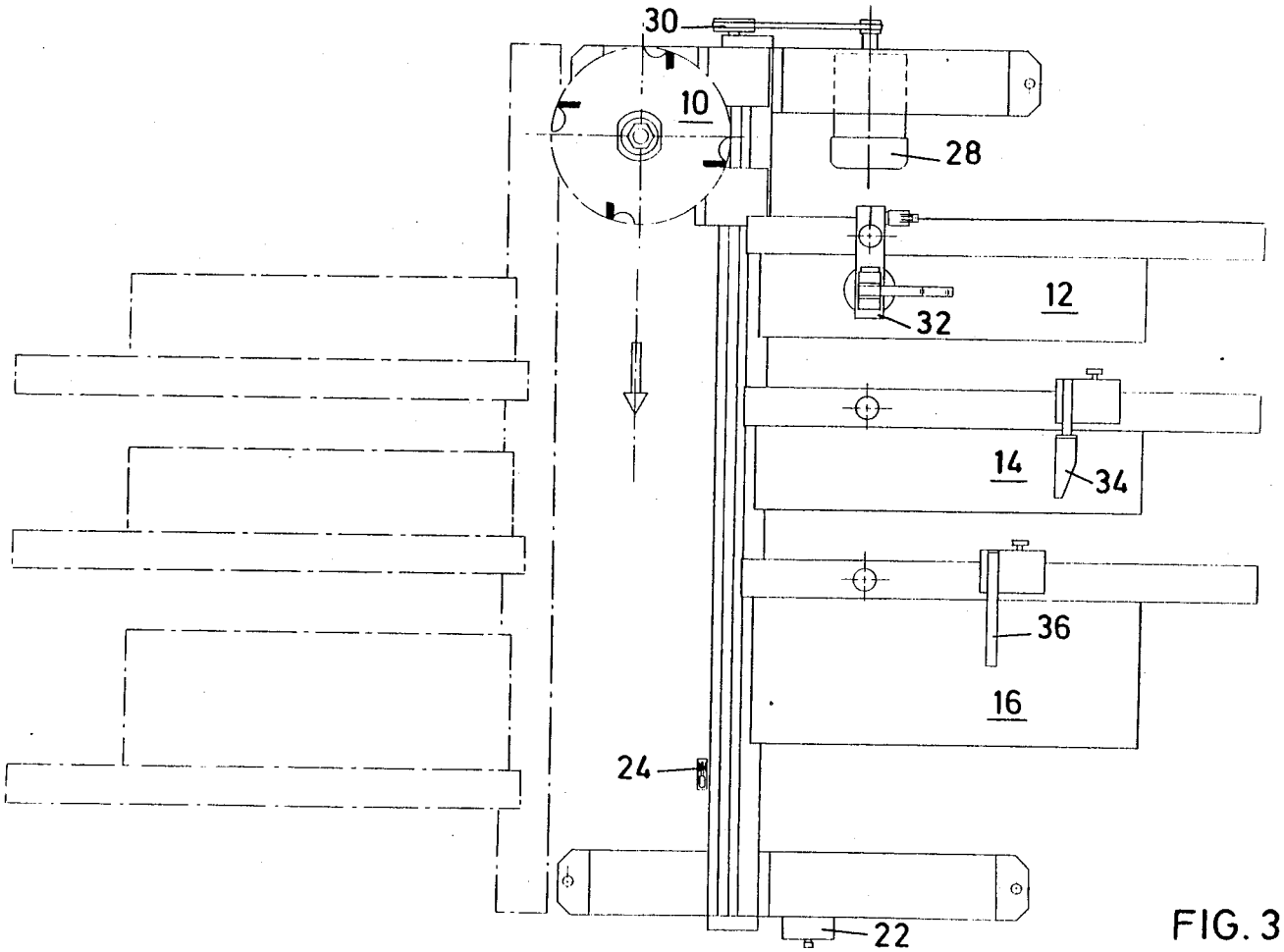
FIG. 3 is a plan corresponding to FIG. 2.

The workpieces may have been cut to a desired length, and or have been moved longitudinally from a position to the other side of the cutter 10 at which the other end has had a joint formed, or may be cut to a desired length by means of a saw (not shown) ahead of the cutter 10 on the carriage 46. A start button on the control panel 22 is then pressed, the main motor 20 is thus actuated and the cutter 10 starts to rotate anti-clockwise as shown in FIG. 3. The traverse motor 28 is then actuated to move the carriage 46 (together with the main motor 20 and cutter 10) along the traverse screw 26 from a park position to the left as shown in FIG. 1 towards the right. As the cutter 10 passes the tables 12, 14, 16, it cuts an end joint in the workpiece clamped on each table. During this pass, the operator can be doing other jobs around the machine. When the cutter 10 reaches the end of its pass, the limit switch 24 is actuated to reverse the traverse motor 28 so that the cutter 10 is returned to its park position. This operation may be controlled so that the return pass is performed more quickly than the advance.

I claim:

1. A machine for cutting end joints comprising a rotary cutter, having a plurality of coaxial cutting discs, spacer means between adjacent discs, means for effecting travel of said cutter along a pre-determined path on said machine, at least two work supporting tables provided adjacent the path of travel of said cutter, means for securing the work pieces on the tables, and adjustable means for presenting said tables at different preselected levels with respect to each other and to the machine.

2. A machine according to claim 1 wherein three work supporting tables are provided in side-by-side relation on one side of the path of travel of the cutter.

3. A machine according to claim 1 wherein work supporting tables are provided on opposite sides of the path of travel of the cutter.

4. A machine according to claim 3 wherein work supporting tables on one side of the path of travel of the cutter are each in alignment with a work supporting table on the opposite side of the path of travel of the cutter, and means for moving a work piece from a table on one side to the aligned table on the other side in timed relation to cutting the work supported on said table on said one side.

5. A machine according to claim 1 wherein stop means are provided on each table for engaging one end of the work for presenting the opposite end within the path of travel of the cutter.

* * * * *